US012258852B1

(12) United States Patent
Aljeaban et al.

(10) Patent No.: US 12,258,852 B1
(45) Date of Patent: Mar. 25, 2025

(54) MULTIPURPOSE DOWNHOLE APPARATUS

(71) Applicant: SAUDI ARABIAN OIL COMPANY, Dhahran (SA)

(72) Inventors: Norah A. Aljeaban, Al Khobar (SA); Faisal Alrasheed, Dammam (SA); Tao Chen, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/472,002

(22) Filed: Sep. 21, 2023

(51) Int. Cl.
*E21B 47/00* (2012.01)
*E21B 37/02* (2006.01)
*E21B 47/002* (2012.01)

(52) U.S. Cl.
CPC ..... *E21B 47/006* (2020.05); *E21B 37/02* (2013.01); *E21B 47/0025* (2020.05)

(58) Field of Classification Search
CPC ..... E21B 47/00
See application file for complete search history.

(56) References Cited

U.S. PATENT DOCUMENTS

| | | | | |
|---|---|---|---|---|
| 6,886,406 | B1 | 5/2005 | Couet et al. | |
| 9,869,172 | B2 | 1/2018 | Donderici et al. | |
| 10,987,707 | B2 | 4/2021 | Saltykov et al. | |
| 11,208,883 | B2 | 12/2021 | Jagannathan et al. | |
| 2005/0016302 | A1* | 1/2005 | Simpson | E21B 47/00 73/865.8 |
| 2016/0168939 | A1 | 6/2016 | Harris et al. | |
| 2016/0199888 | A1 | 7/2016 | Jaaskelainen | |
| 2021/0333238 | A1* | 10/2021 | Saeed | G01N 29/11 |
| 2022/0034739 | A1 | 2/2022 | Zhang et al. | |
| 2022/0213761 | A1* | 7/2022 | Bulekbay | E21B 27/00 |
| 2022/0283331 | A1 | 9/2022 | Volker et al. | |

FOREIGN PATENT DOCUMENTS

| | | | |
|---|---|---|---|
| CN | 212563170 | U | 2/2021 |
| WO | 2017/180131 | A1 | 10/2017 |
| WO | 2019/099990 | A1 | 5/2019 |

OTHER PUBLICATIONS

Rostron, Paul, "Critical Review of Pipeline Scale Measurement Technologies"; Indian Journal of Science and Technology; vol. 11, Issue 17; pp. 1-18; May 2018 (18 pages).

(Continued)

*Primary Examiner* — William D Hutton, Jr.
*Assistant Examiner* — Avi T Skaist
(74) *Attorney, Agent, or Firm* — Osha Bergman Watanabe & Burton LLP

(57) ABSTRACT

A system for surveying internal pipeline scaling includes a control system, a gauge cutter, a scale recorder, and a wireline. The control system communicates with the scale recorder to obtain scale recorder data and acoustic images. The gauge cutter dislodges scaling debris from an interior wall of the pipeline and includes a fluid permeable screen which collects the dislodged scaling debris. The scale recorder obtains scale recorder data and acoustic images, and includes an ultrasound wave transmitter, an ultrasound wave receiver, a processor, a memory, and a communication interface. The wireline lowers the gauge cutter in the pipeline and is coupled to the control system and the communication interface.

20 Claims, 4 Drawing Sheets

(56) References Cited

OTHER PUBLICATIONS

Hoffmann, J. et al., "Acoustic Imaging Techniques for Characterization of Corrosion, Corrosion Protective Coatings, and Surface Cracks"; Nondestructive Materials Characterization, Chapter 11; Springer Series in Materials Science, vol. 67; pp. 294-322; 2004 (29 pages).
Abdallah, Dalia et al., "Casing Corrosion Measurement to Extend Asset Life"; Oilfield Review; vol. 25, No. 3; pp. 18-31; Autumn 2013 (14 pages).
Frisch, G. et al., "Advanced Ultrasonic Scanning Tool and Evaluation Methods Improve and Standardize Casing Inspection"; Proceedings of the SPE Annual Technical Conference and Exhibition; Paper No. SPE-71399-MS; pp. 1-15; Sep. 30, 2001 (15 pages).
Hayman, A.J. et al., "Improved Borehole Imaging by Ultrasonics"; SPE Production & Facilities; vol. 13, Issue 01; pp. 5-14; Feb. 1998 (9 pages).

* cited by examiner

MULTIPURPOSE DOWNHOLE APPARATUS

BACKGROUND

Commercially, well sites are commonly used to transmit oil from below the surface of the Earth up to a drilling rig. Once drilled, oil is lifted from the wellbore to the surface through a pipeline or production tubing. During this process, particulate that is stored in the oil may be transferred to the inner surface of the pipeline due to a change in temperature, pressure, or other wellbore operating conditions. Over time, the transferred particulate accumulates on the interior of the pipeline, causing the internal diameter of the pipeline to shrink and the overall efficiency of the well drilling system to decrease.

In this way, it is important to determine the level of scaling present in the pipeline in order to develop a remediation plan for the shrinking internal diameter of the pipeline. As a result of determining the level of scaling and presenting the level of scaling to an operator, the operator is further provided with the data needed to make an informed decision regarding the remediation plan.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one or more aspects, embodiments of the present invention relate to a system for surveying internal pipeline scaling includes a control system, a gauge cutter, a scale recorder, and a wireline. The control system communicates with the scale recorder to obtain scale recorder data and acoustic images. The gauge cutter dislodges scaling debris from an interior wall of the pipeline and includes a fluid permeable screen which collects the dislodged scaling debris. The scale recorder obtains scale recorder data and acoustic images, and includes an ultrasound wave transmitter, an ultrasound wave receiver, a processor, a memory, and a communication interface. The wireline lowers the gauge cutter in the pipeline and is coupled to the control system and the communication interface.

In one or more aspects, embodiments of the present invention relate to a method to survey scaling on an interior wall of a pipeline includes lowering a gauge cutter into the pipeline with a wireline. The method further includes sending instructions from a control system to a scale recorder to obtain scale recorder data. Subsequently, the method includes receiving the instructions using a communication interface. In addition, the method includes emitting incident ultrasound waves from an ultrasound wave transmitter. Next, the method includes detecting the reflected ultrasound waves received from the interior wall of the pipeline and the scaling of the pipeline using an ultrasound wave receiver. Then, the method includes analyzing the reflected ultrasound waves detected by the ultrasound wave receiver and producing an acoustic image of the scaling on the interior wall of the pipeline and the scale recorder data using a processor. The method further includes storing the acoustic image and the scale recorder data using a memory. Moreover, the method includes transmitting the acoustic image and the scale recorder data to the control system using the wireline coupled to the communication interface. Furthermore, the method includes dislodging scaling debris from the interior wall of the pipeline using the gauge cutter. Finally, the method includes collecting the dislodged scaling debris using the gauge cutter.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Figure 1:
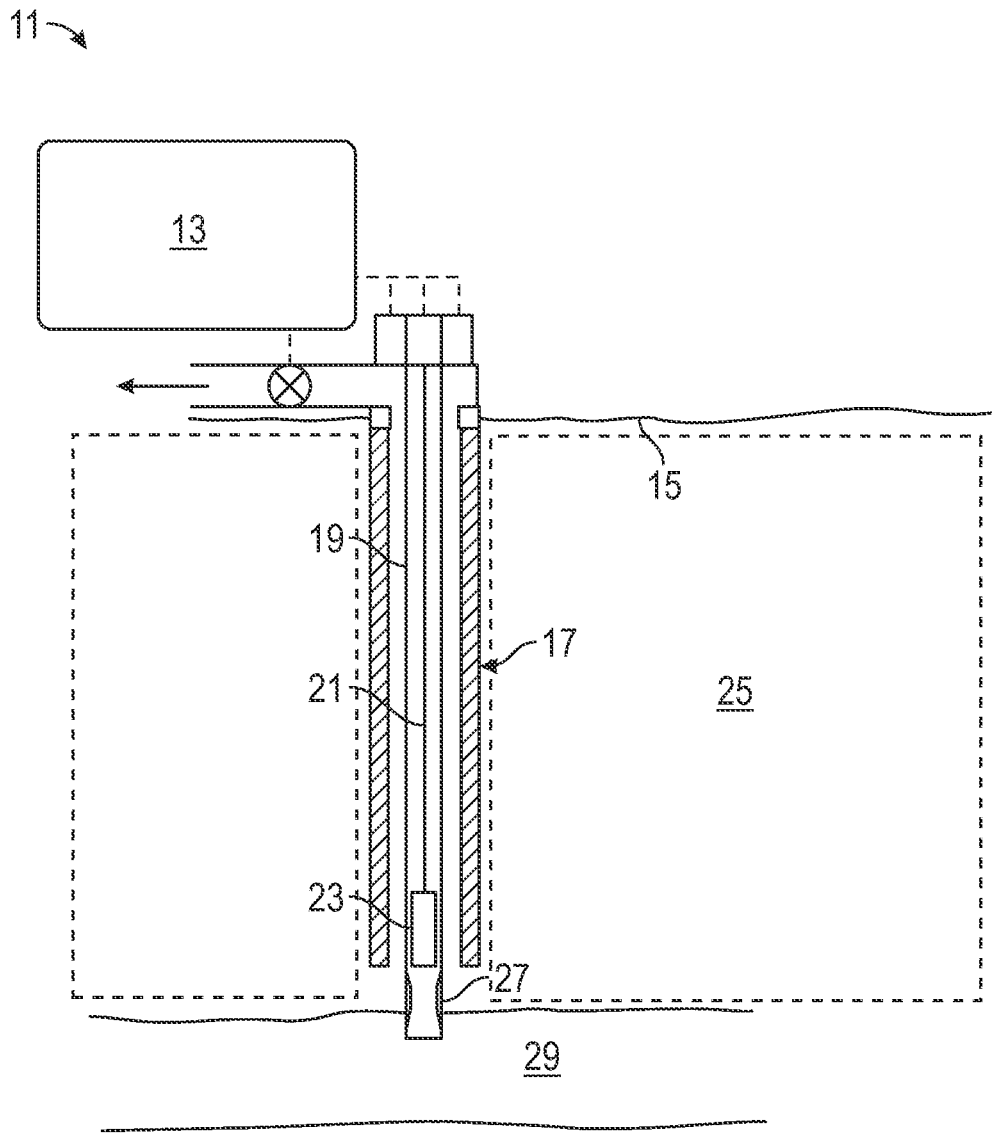
FIG. 1 depicts a well site in accordance with one or more embodiments of the invention.

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a wellbore as described herein. In this respect, the term "upper" denotes an element disposed closer to the surface of the Earth than a corresponding "lower" element when the surveying system is in the wellbore, while the term "lower" conversely describes an element disposed further from the surface of the Earth than a corresponding "upper" element. Similarly, the term "downhole" may be used when referring to any position inside the wellbore beneath the surface. Likewise, the term "axial" refers to an orientation substantially parallel to an extension direction of a wellbore, while the term "radial" denotes a direction orthogonal to an axial direction. Similarly, the terms "vertical" and "vertically" refer to an axial direction (i.e., the primary extension direction of the wellbore) while the terms "lateral" and "laterally" refer to the radial direction orthogonal to a vertical direction.

In general, one or more embodiments of the present invention are directed towards a system for monitoring scaling and corrosion in a pipeline. The system includes a control system, a gauge cutter, a scale recorder, and a wireline. During the process of transporting oil or natural gas through a pipeline, particulates accumulate on the inner surface of the pipeline. The particulates may include, for example, calcium carbonate (limescale), iron sulfides, barium sulfate, strontium sulfate, or similar minerals. Due to being trapped below the surface of the Earth under high temperatures and pressures, the particulates are initially dissolved in the oil or other production fluids stored within the pipeline. As the oil is lifted through the pipeline, the temperature and pressure of the oil decreases, which causes the previously dissolved particulates to precipitate and accumulate on the sides of the pipeline. As the scaling accumulates, the pipeline may become closed off, preventing oil from being lifted through the pipeline. By surveying scaling in a pipeline in-situ, the proposed design advantageously detects scaling formation and other deposits in the pipeline at an early stage, preventing reduced production, decreased flow rate, or an increase in pressure drop.

FIG. 1 shows a schematic diagram illustrating an example of a well site 11 in accordance with one or more embodiments of the invention. In general, well sites 11 are configured in a myriad of ways. Therefore, the well site 11 is not intended to limit the particular configuration of the system for surveying internal pipeline scaling 27. For example, the well site 11 is depicted as being on land, however the well site 11 can be offshore and monitoring the scaling 27 and corrosion in the pipeline 19 may be carried out with or without the use of a marine riser. Moreover, various components and details of the well site 11 that would be well known to a person of ordinary skill in the art have been omitted for the sake of brevity.

The process of monitoring the scaling 27 and corrosion in the pipeline 19 at the well site 11 is initiated by drilling a wellbore 17 into a subterranean formation 25 ("formation"). The formation 25 may include a porous or fractured rock formation that resides underground, beneath the Earth's surface 15 ("surface"). The surface 15 of the well site 11 is a reference position for where the wellbore 17 originates, and the wellbore 17 extends in an axial direction from the surface 15. For the purpose of drilling the wellbore 17 into the formation 25, equipment such as a crown block and derrick (not shown) suspends and rotates a drill string (not shown) to break the formation 25 and create the wellbore 17. The pipeline 19 is installed in the wellbore 17 during drilling and transports oil or gas from a reservoir 29 in the wellbore 17. The pipeline 19 may be formed of one or more varieties of steel (such as martensitic steel, duplex steel, or a steel alloy). As discussed above, as time passes, particulates accumulate on the interior wall of the pipeline 19, and scaling 27 and corrosion can occur.

A wireline 21 is configured to lower tools into the pipeline 19 and comprises an electrical cable which can transmit data between a well control system 13 disposed on the surface 15 and the tools coupled to the wireline 21. A plurality of tools may be coupled to the wireline 21 to gather downhole data. Specifically, in the current embodiment, a gauge cutter 23 is coupled to the wireline 21 and lowered into the pipeline 19 to dislodge and collect samples of scaling debris 33 which has accumulated in the pipeline 19. In addition, a scale recorder (e.g., FIG. 2), connected to the gauge cutter 23, is configured to generate scale recorder data, the scale recorder data comprising a location, a distribution, a texture, and a thickness of the scaling 27 in the pipeline 19. The well control system 13 transmits instructions, via the wireline 21, to the gauge cutter 23 and the scale recorder (e.g., FIG. 2) in real time to obtain scale recorder data, samples of scaling debris 33, and an acoustic image of the scaling 27 in the pipeline 19.

Figure 2:
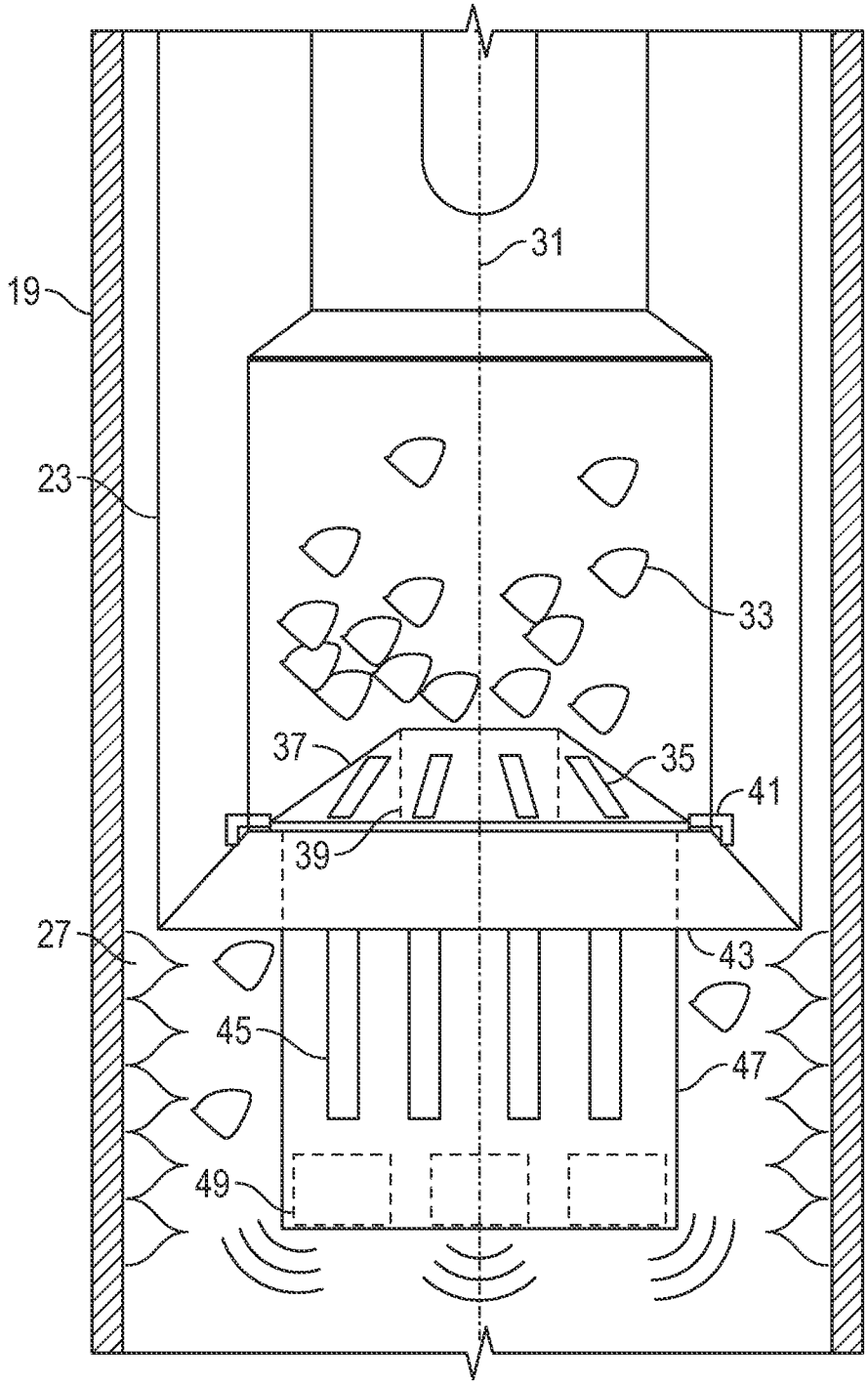
FIG. 2 depicts a side view of a system for surveying internal pipeline scaling in accordance with one or more embodiments of the invention.

Turning to FIG. 2, FIG. 2 depicts the gauge cutter 23 dislodging and collecting samples of scaling debris 33 from an inner wall of the pipeline 19 while the scale recorder 49 generates scale recorder 49 data and acoustic images of the scaling 27 in the pipeline 19. The gauge cutter 23 further comprises a fluid permeable screen 37 and a cutting blade 43. The fluid permeable screen 37 is configured to collect the scaling debris 33 dislodged by the cutting blade 43 through screen slots 35, and the cutting blade 43 is a beveled edge at the lower most part of a conical section of the gauge cutter 23 configured to scrape debris from the pipeline 19. Furthermore, the fluid permeable screen 37 is secured in place by an attachment tab 41. The fluid permeable screen 37 is inserted beneath the attachment tab 41 which extends around the outer perimeter of the fluid permeable screen 37.

The gauge cutter 23 further comprises an internal orifice 39, a channel extending through the from the exterior housing 47 to the top of the fluid permeable screen 37. The internal orifice 39 is configured to pass the scaling debris 33 taken in through the rectangular slots 45 of the exterior housing 47 into the gauge cutter 23. An opening (not shown) at the top of the fluid permeable screen 37 allows the scaling debris 33 to enter the gauge cutter 23. The screen slots 35 are configured to pass the scaling debris 33 taken in through the bottom slots (e.g., FIG. 3) into the gauge cutter 23.

The scale recorder 49 is disposed in an exterior housing 47, and the exterior housing 47 is connected to a lower most surface of the gauge cutter 23. The exterior housing 47 comprises rectangular slots 45 to allow removed scaling debris 33 to enter the gauge cutter 23 while preventing the scaling debris 33 from impacting the scale recorder 49. The scale recorder 49 is further disposed below the rectangular slots 45 of the exterior housing 47. In addition, the scale recorder 49 is oriented coaxially with a vertical axis 31 that extends through the gauge cutter 23, and the gauge cutter 23 comprises a first outer diameter in a direction orthogonal to the vertical axis 31 that is larger than a second outer diameter of the exterior housing 47. For example, in the current embodiment, a plurality of scale recorders 49 are disposed in the exterior housing 47 and each scale recorder 49 is configured to receive a different reflected ultrasound wave after an incident ultrasound wave has been emitted from the plurality of scale recorders 49 and reflected on the scaling 27 on the pipeline 19 wall.

The scale recorders 49 emit ultrasound waves which are reflected on the scaling 27 on the pipeline 19 wall and received by the scale recorders 49. The ultrasound waves are of a frequency between 2 Megahertz (MHz) to 18 MHz. The scale recorder 49, discussed in more detail below, uses the ultrasound waves to determine properties of the scaling 27 on the pipeline 19 wall, as well as produce an acoustic image of the scaling 27 on the pipeline 19 wall. Acoustic imaging is a technique that uses sound waves to create visual representations of objects or environments. The technique comprises emitting sound waves which reflect off different surfaces and then measuring the reflected waves taking into account the amount of time taken for the wave to return, considering the medium through which the waves traveled through (e.g., air, water, oil, etc.), and the intensity of the waves. Processing these factors together generates detailed images or maps of the objects or environments being measured, and can provide spatial information a standard optical camera alone would be unable to provide.

Figure 3:
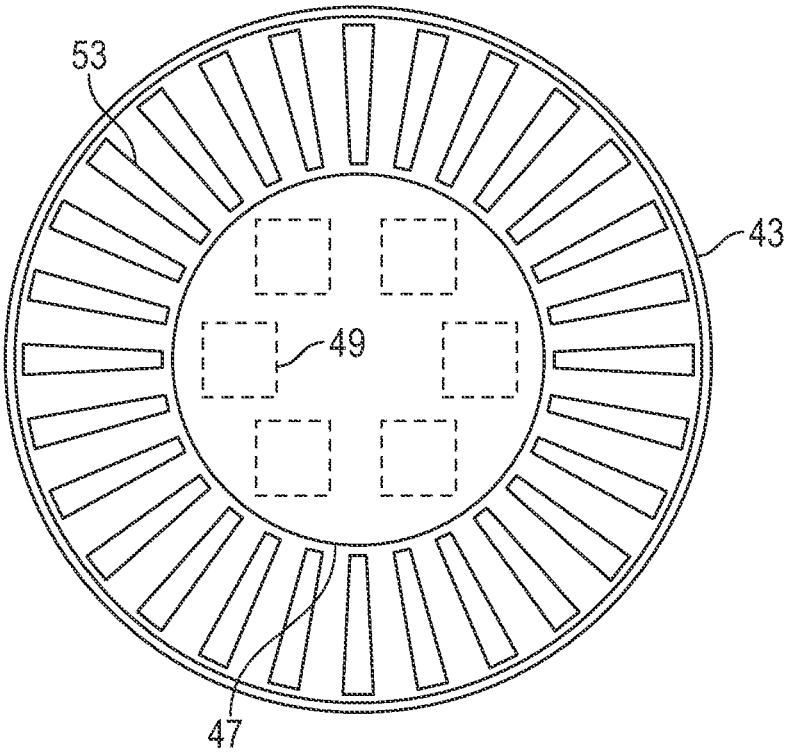
FIG. 3 depicts a bottom view of the system for surveying internal pipeline scaling in accordance with one or more embodiments of the invention.

Turning to FIG. 3, FIG. 3 depicts a bottom view of the gauge cutter 23 and the exterior housing 47 comprising a plurality of scale recorders 49. The cutting blade 43 extends from the gauge cutter 23 conically where the edge comprises a beveled edge to scrape and dislodge scaling debris 33 from the pipeline 19 wall. The first outer diameter of the cutting blade 43 (and thus the gauge cutter 23) is larger than the second outer diameter of the exterior housing 47, shown in the interior circle. Between the cutting blade 43 and the exterior housing 47, the gauge cutter 23 comprises a plurality of bottom slots 53 configured for passing scaling debris 33 into the gauge cutter 23. The current embodiment depicts the exterior housing 47 comprising six scale recorders 49, however the exterior housing 47 may comprise one or more scale recorders 49 at the discretion of the operator.

Figure 4:
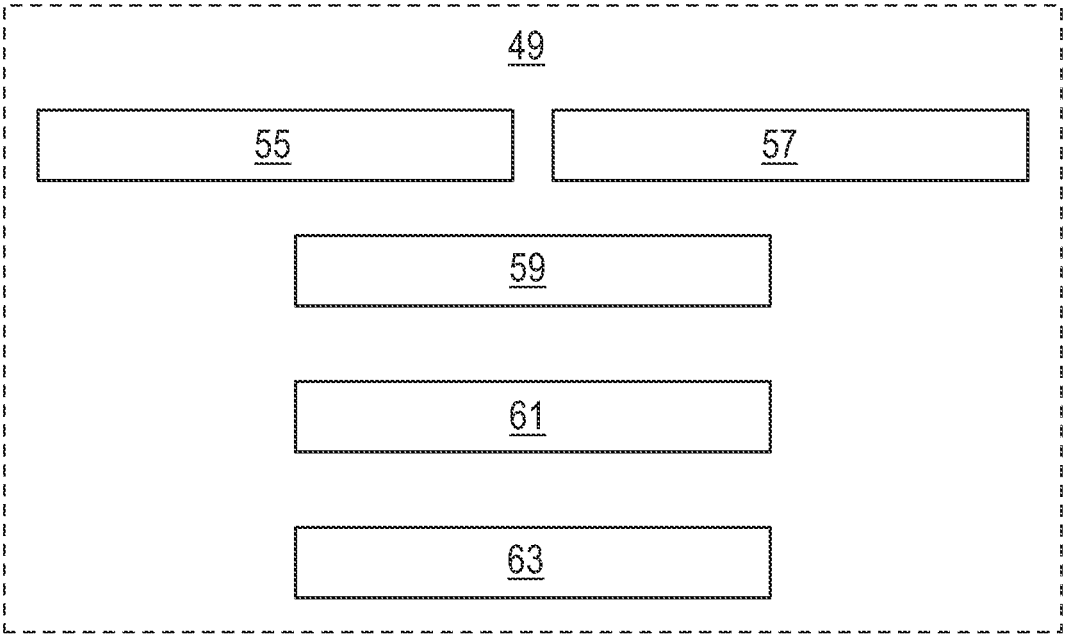
FIG. 4 depicts a scale recorder in accordance with one or more embodiments of the invention.

Turning to FIG. 4, FIG. 4 depicts a diagram of the scale recorder 49. The scale recorder 49 comprises an ultrasound wave transmitter 55, an ultrasound wave receiver 57, a processor 59, a memory 61, and a communication interface 63. The ultrasound wave transmitter 55 is configured to emit incident ultrasound waves with a frequency between 2 MHz to 18 MHz. The ultrasound wave receiver 57 is configured to detect reflected ultrasound waves received from the interior wall and scaling 27 of the pipeline 19. Additionally, the ultrasound wave receiver 57 is further configured to generate scale recorder data based upon the reflected ultrasound waves, the scale recorder data comprising a location, a thickness, a distribution, and a texture of the scaling 27 disposed on the interior wall of the pipeline 19. The processor 59 is configured to analyze the scale recorder data and produce an acoustic image of the pipeline 19 and scaling 27 on the interior wall of the pipeline 19. The memory 61, comprising a non-transient storage medium, is configured to store the acoustic image and the scale recorder data. Finally, the wireline 21 is coupled to the control system and the communication interface 63, allowing the control system and scale recorder 49 to communicate in real time. The control system is configured to send instructions to the scale recorder 49 to obtain the scale recorder data and acoustic images, and the scale recorder 49 is further configured to transmit the scale recorder data and the acoustic image to the control system via the communication interface 63.

The acoustic image utilizes ultrasound waves within a frequency of 2 MHz to 18 MHz because waves within this frequency range can pass through the accumulated scaling 27 and be reflected off of the pipeline 19 itself. The specific frequency implemented is decided at the discretion of the operator or manufacturer.

Further discussing the process of producing an acoustic image, an acoustic image can be defined as an image encompassing a level of scaling 27 at a corresponding depth of the pipeline 19, such that the acoustic image depicts a part or all of the pipeline 19, as well as a level of scaling 27 present in the depicted portion of the pipeline 19. The acoustic image is produced when mechanical vibrations, arising from sound, are translated into a visual representation of the ultrasound waves.

The emitted ultrasound waves from the ultrasound wave transmitter 55 pass through a first medium (e.g., air or oil) at a known rate, and pass through a second medium (i.e., the scaling 27) at a second known rate, and finally reflect off a boundary (i.e., the interior wall of the pipeline 19), and return as reflected ultrasound waves to the ultrasound wave receiver 57. The thickness of the scaling 27 is a relative measure of the difference of time for the waves to pass through the first and second mediums. Thus, an acoustic image is produced taking into account the Time of Flight (ToF) taken for the emitted ultrasound waves to return as reflected ultrasound waves.

The current embodiment of the scale recorder 49 comprises one ultrasound wave transmitter 55 and one ultrasound wave receiver 57, however the scale recorder 49 may alternatively comprise one or more ultrasound wave transmitters 55 at the discretion of the operator. If the system for surveying the scaling 27 on the interior wall of the pipeline 19 comprises only one ultrasound wave transmitter 55, the incident ultrasound waves would likely need to be emitted in a radial direction orthogonal to the vertical axis 31 in order for only one ultrasound wave transmitter 55 to produce a complete acoustic image. However, the system comprises more than one ultrasound wave transmitter 55, the incident waves may be emitted from multiple sources allowing for a complete mapping of the pipeline 19 to produce a complete acoustic image.

For example, the current embodiment in FIG. 3 shows six scale recorders 49, all of which are emitting incident ultrasound waves and receiving reflected ultrasound waves. However, the scale recorder 49 may be configured to comprise multiple ultrasound wave transmitters 55 such that only one scale recorder 49 is necessary to emit incident ultrasound waves to map the entire desired area of the pipeline 19. In this example, only one ultrasound wave receiver 57 is necessary.

Figure 5:
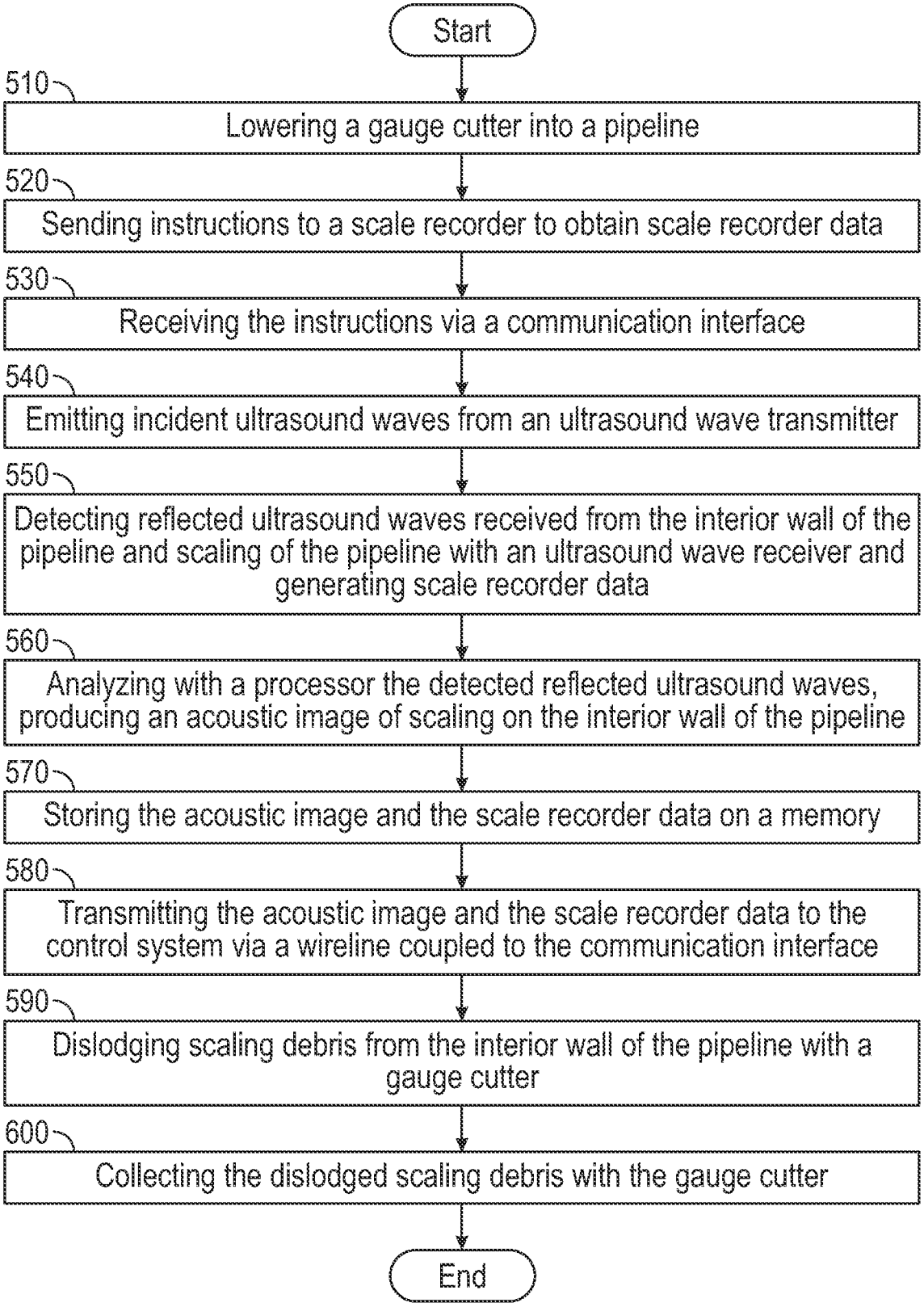
FIG. 5 depicts a flowchart of a method in accordance with one or more embodiments of the invention.

Turning to FIG. 5, FIG. 5 depicts a method for surveying the scaling 27 on the interior wall of the pipeline 19 in accordance with one or more embodiments of the invention. While the various blocks in FIG. 5 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially, in Step 510, a gauge cutter 23 is lowered into a pipeline 19. A wireline 21 is used for lowering the gauge cutter 23 from the surface 15 of the well site 11. The well control system 13 determines the rate at which the wireline 21 is lowered.

During Step 520, instructions are sent from a well control system 13 to a scale recorder 49, via the wireline 21, to obtain scale recorder data. The scale recorder data comprises a location, a distribution, a texture, and a thickness of the scaling 27 disposed on an interior wall of the pipeline 19.

In Step 530, the scale recorder 49 receives the instructions from the well control system 13 through a communication interface 63. The wireline 21 is coupled to the control system and the communication interface 63, where the wireline 21 comprises an electrical cable configured to transmit data.

In Step 540, an ultrasound wave transmitter 55 emits incident ultrasound waves. The ultrasound wave transmitter 55 is a component comprised within the scale recorder 49 and emits ultrasound waves at a frequency between 2 MHz and 18 MHz.

In Step 550, an ultrasound wave receiver 57 detects reflected ultrasound waves received from the interior wall of the pipeline 19 and scaling 27 of the pipeline 19. The incident ultrasound waves which were emitted by the ultrasound wave transmitter 55 become reflected ultrasound waves after traveling through a medium in the pipeline 19 (e.g., oil, water, air) and reflecting off the scaling 27 and the pipeline 19 wall. The ultrasound wave receiver 57 is further configured to generate the scale recorder data from the detected reflected ultrasound waves.

In Step 560, a processor 59 analyzes the detected reflected ultrasound waves and the scale recorder data to produce an acoustic image of the scaling 27 on the interior wall of the pipeline 19.

In Step 570, the acoustic image and the scale recorder data are stored on a memory 61. The memory 61 comprises a non-transient storage medium. In the case that the connection between the scale recorder 49 and the well control system 13 becomes disconnected, the memory 61 acts as a data backup that can be accessed after the gauge cutter 23 has been raised to the surface 15.

In Step 580, the acoustic image and the scale recorder data are transmitted from the communication interface 63 to the control system via the wireline 21.

In Step 590, the gauge cutter 23 dislodges scaling debris 33 from the interior wall of the pipeline 19. The gauge cutter 23 comprises a beveled edge configured to scrape the scaling debris 33 from the pipeline 19.

Finally, in Step 600, after dislodging scaling debris 33 from the interior wall of the pipeline 19, the gauge cutter 23 collects the dislodged scaling debris 33 for sampling. The gauge cutter 23 further comprises a fluid permeable screen 37 which collects the dislodged scaling debris 33. The fluid permeable screen 37 comprises slots to allow the dislodged scaling debris 33 to pass through and be collected in the gauge cutter 23.

Accordingly, the aforementioned embodiments of the invention as disclosed relate to systems and methods useful in detecting scaling 27 formation and other deposits in a pipeline 19 at an early stage, preventing reduced production, decreased flow rate, or an increase in pressure drop.

Although only a few example embodiments have been described in detail above, those skilled in the art will readily appreciate that may modifications are possible in the example embodiments without materially departing from the invention, for example, either multiple scale recorders 49 or a single scale recorder 49 comprising multiple ultrasound wave transmitters 55 may be used for the system. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for surveying internal pipeline scaling comprising:

a control system disposed on a well surface;

a gauge cutter configured to dislodge scaling debris from an interior wall of a pipeline, the gauge cutter comprising:

a fluid permeable screen configured to collect the scaling debris dislodged by the gauge cutter;

a scale recorder coupled to the gauge cutter, the scale recorder comprising:

an ultrasound wave transmitter configured to emit incident ultrasound waves, an ultrasound wave receiver configured to detect reflected ultrasound waves received from the interior wall of the pipeline and scaling of the pipeline, wherein the ultrasound wave receiver is configured to generate scale recorder data based upon the reflected ultrasound waves, a processor configured to analyze the scale recorder data to produce an acoustic image, a memory configured to store the acoustic image and the scale recorder data, and a communication interface; and a wireline configured to lower the gauge cutter in the pipeline;

wherein the wireline is coupled to the control system and the communication interface; and wherein the control system is configured to send instructions to the scale recorder to obtain the scale recorder data and the acoustic image, and the scale recorder is configured to transmit the scale recorder data and the acoustic image to the control system via the communication interface.

2. The system of claim 1, further comprising: an exterior housing configured to prevent the scaling debris from impacting the scale recorder.

3. The system of claim 2, wherein the exterior housing comprises rectangular slots to allow removed scaling to enter the gauge cutter.

4. The system of claim 2, wherein the exterior housing and the scale recorder are connected to a lower most surface of the gauge cutter.

5. The system of claim 3, wherein the scale recorder is disposed below the rectangular slots of the exterior housing.

6. The system of claim 2, further comprising: a plurality of ultrasound wave receivers disposed in the exterior housing, each of the ultrasound wave receivers being configured to receive a different reflected ultrasound wave.

7. The system of claim 1, wherein the gauge cutter further comprises a beveled edge configured to scrape the scaling debris from the pipeline.

8. The system of claim 1, wherein the ultrasound wave transmitter emits ultrasound waves within a frequency of 2 Megahertz (MHz) to 18 MHz.

9. The system of claim 1, wherein the memory comprises a non-transient storage medium configured to store the acoustic image and the scale recorder data.

10. The system of claim 1, wherein the scale recorder data comprising a location, a distribution, a texture, and a thickness of the scaling disposed on the interior wall of the pipeline.

11. The system of claim 2, wherein the scale recorder is oriented coaxially with a vertical axis that extends through the gauge cutter.

12. The system of claim 11, wherein the gauge cutter comprises a first outer diameter in a direction orthogonal to the vertical axis that is larger than a second outer diameter of the exterior housing.

13. A method to survey scaling on an interior wall of a pipeline, the method comprising:

lowering, via a wireline, a gauge cutter into the pipeline;

sending instructions, via a control system, to a scale recorder to obtain scale recorder data;

receiving the instructions via a communication interface;

emitting, via an ultrasound wave transmitter, incident ultrasound waves;

detecting, via an ultrasound wave receiver, reflected ultrasound waves, received from the interior wall of the pipeline and the scaling of the pipeline;

analyzing, via a processor, the reflected ultrasound waves detected by the ultrasound wave receiver and producing an acoustic image of the scaling on the interior wall of the pipeline and the scale recorder data;

storing, via a memory, the acoustic image and the scale recorder data;

transmitting, via the wireline coupled to the communication interface, the acoustic image and the scale recorder data to the control system;

dislodging, via the gauge cutter, scaling debris from the interior wall of the pipeline; and collecting, via the gauge cutter, the dislodged scaling debris.

14. The method of claim 13, further comprising: receiving a different reflected ultrasound wave with one ultrasound receiver of a plurality of ultrasound receivers.

15. The method of claim 13, further comprising: preventing the scaling debris from impacting the scale recorder with an exterior housing.

16. The method of claim 15, further comprising: passing scaling debris through rectangular slots in the exterior housing such that the scaling debris is disposed in the gauge cutter.

17. The method of claim 13, wherein collecting the scaling debris further comprises: scraping the scaling debris from the pipeline with a bevelled edge of the gauge cutter.

18. The method of claim 13, wherein the scale recorder data comprises properties of the scaling from the interior wall of the pipeline, the properties comprising a location, a distribution, a texture, and a thickness of the scaling.

19. The method of claim 13, further comprising: emitting the incident ultrasound waves within a frequency of 2 Megahertz (MHz) to 18 MHz with the ultrasound wave transmitter.

20. The method of claim 13, further comprising: storing the acoustic image and the scale recorder data on a non-transient storage medium comprised in the memory.

* * * * *